US006119385A

United States Patent [19]

Olivier

[11] Patent Number: 6,119,385

[45] **Date of Patent: *Sep. 19, 2000**

[54] DOOR ATTACHMENT

[76] Inventor: Archie A. Olivier, 3708 Saddlehead Dr., Plano, Tex. 75075

[ * ] Notice: This patent is subject to a terminal disclaimer.

[21] Appl. No.: 08/845,861

[22] Filed: Apr. 28, 1997

[51] Int. Cl.[7] ..... G09F 23/00

[52] U.S. Cl. ..... 40/661.12; 40/599

[58] Field of Search ..... 40/661.12, 661.09, 40/124.191, 331, 626, 630, 638, 594, 595, 599, 615, 773, 774, 800

[56] References Cited

U.S. PATENT DOCUMENTS 2,180,670 11/1939 Erickson ..... 40/599
5,010,672 4/1991 Coleman ..... 40/615

*Primary Examiner*—Cassandra H. Davis
*Attorney, Agent, or Firm*—Jack A. Kanz

[57] ABSTRACT

A combination door handle and graphic display is formed by securing a display between an opaque first body portion and transparent second body portion. A rear side surface of the transparent second body portion is fused to a front side surface of the opaque first body portion and a graphic display decal is mounted to the front side surface of the transparent second body portion. The front side surface of the transparent second body portion is fused to the rear side surface of a transparent third body portion to fixedly secure a graphic display therebetween. The graphic display is visible through the transparent third body portion and the opaque first body portion provides a backdrop against which the graphic display contrasts. The transparent second body portion spaces the graphic display decal relative to the opaque first body portion such that the display appears in a foreground relative to the backdrop.

23 Claims, 1 Drawing Sheet

DOOR ATTACHMENT

BACKGROUND OF THE INVENTION

Almost every entryway to a retail store or other commercial building includes a door. In addition to defining the boundary of the retail establishment, doors serve a variety of useful purposes including, among others, protecting the interior of the building from the elements. Thus, doors to most retail establishments are normally in the closed position. To enter the retail establishment, therefore, a patron must first open the door. In most cases this is accomplished by pulling the door toward the body. To assist the patron with this task, most doors have a handle attached thereto. By grasping and pulling the door handle, the patron can pivot the door around a hinged edge thereof, thereby opening the door with relative ease.

Typically, a door handle includes a knob, shaft or other member which is positioned several inches forward of a front side surface of the door. The handle is mounted to the door such that force applied to the handle is transferred to the door itself. To maximize transfer of force to the door while maintaining ease of use, the handle is typically positioned in proximity to a free edge of the door and about three feet above the bottom edge.

A door attachment closely related to the door handle is commonly referred to as a "push pad". Relative to the door handle, the push pad is mounted to the opposite side of the door, i.e., the side which must be pushed to open the door. Since the patron need not grasp or pull the push pad (as with a door handle) a push pad is typically elongated along its horizontal axis and often shortened along its vertical axis.

For most business establishments, door handles and/or push pads serve only the aforementioned task of assisting in opening doors. Thus, door handles and/or push pads are typically viewed as purely functional devices. To improve the appearance of a business establishment, door handles and push pads are sometimes ornately configured. Rarely, however, are these devices customized for a particular business by incorporating a company logo or other signage into the handle or push pad. Furthermore, those occasional prior attempts to do so have produced less than satisfactory results. Specifically, door handles having a metal exterior surface shaped to incorporate a company logo and painted to correspond to the company's color scheme are known. Not only are such door handles exceedingly expensive to manufacture, repeated touching of the door handle often causes the painted exterior surface to quickly appear worn, thereby resulting in added costs of frequent touch-ups.

SUMMARY OF THE INVENTION

In accordance with the present invention, a door attachment is formed which comprises first and second body portions and a graphic display. The display may be a decal displaying a business logo positioned between a front side surface of the first body portion and a rear side surface of the second body portion. The front side surface of the first body portion is fused to the rear side surface of the second body portion to fixedly secure the graphic display decal therebetween. The second body portion is transparent so that the graphic display decal is visible therethrough. In alternate aspects thereof, the graphic display decal may be mounted to the front side surface of the first body portion or to the rear side surface of the second body portion before the front side surface of the first body portion is fused to the rear side surface of the second body portion. The first body portion may be transparent or opaque.

The door attachment may be in the form of a door handle with the first body portion including an indentation formed in a rear side surface of the first body portion. In the preferred embodiment the door attachment includes a bracket having a first section mounted to the rear side surface of the first body portion, a second section configured for mounting to a door and an intermediate section which couples the first section to the second section. The first section of the bracket is angled relative to the second section thereof and the first section includes a front side surface mounted to the rear side surface of the first body portion and a rear side surface having a projection which provides a second gripping surface for the door handle and which may extend from top to bottom side surfaces of the first section of the bracket.

The present invention is preferably used as a combination of a door attachment and graphic display which includes an opaque first body portion and transparent second and third body portions. A rear side surface of the transparent second body portion is fused to a front side surface of the opaque first body portion. A front side surface of the transparent second body portion is fused to a rear side surface of the transparent third body portion to fixedly secure a graphic display therebetween. The graphic display is visible through the transparent third body portion with the opaque first body portion providing a backdrop against which the graphic display contrasts and the transparent second body portion spacing the display relative to the opaque first body portion such that the display appears in a foreground relative to the backdrop. The graphic display may be mounted to the front side surface of the transparent second body portion or to the rear side surface of the transparent third body portion before the front side surface of the transparent second body portion is fused to the rear side surface of the transparent third body portion.

BRIEF DESCRIPTION OF THE DRAWING

The advantages and features of the invention will be better understood when taken in connection with the appended claims and attached drawing in which:

DESCRIPTION OF THE PREFERRED EMBODIMENTS

Figure 1:
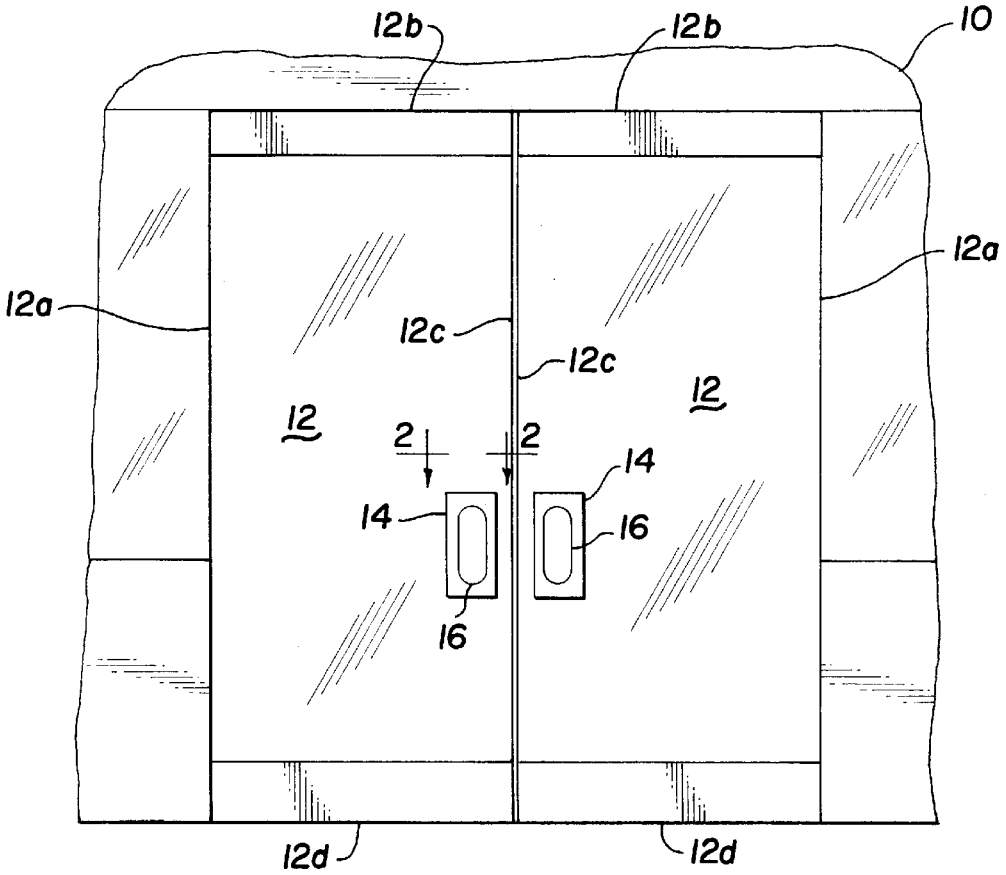
FIG. 1 is a partial front view of a building having a door to which a door handle constructed in accordance with the present invention is attached.

FIG. 1 illustrates a building 10 such as a retail store located in a strip center or other commercial structure which may be entered via either one of a pair of conventionally designed doors 12. Each door 12 includes a first edge 12*a*, a top edge 12*b*, a second edge 12*c* and a bottom edge 12*d*. The first edge 12*a* is pivotally attached to the building 10 while the top, second and bottom edges 12*b*, 12*c* and 12*d* are unattached. Fixedly mounted to a front side surface of each door 12 is a door attachment 14 constructed in accordance with the present invention to incorporate a readily visible graphic design 16. While the door attachment 14 disclosed is a door handle, it should be understood that the terms "handle" and "attachment" encompass a wide variety of types of door attachments, including push pads and the like. Furthermore, while the attachment 14 is shown mounted on the door 10, it should be understood that the attachment is equally suitable for mounting on surfaces other than those described herein. Also, while the graphic design 16 may include any artistic rendering, for most commercial establishments the business name, logo and/or visual design which enjoys an association with the commercial establishment is preferred. Furthermore, while the graphic design 16 may include black or another color or colors of print on a transparent, white or other opaquely colored background, color combinations associated with the commercial establishment are generally preferred.

The door attachment 14 is mounted in proximity to the second edge 12*c* so that the door 12 may be readily pivoted into an open position by grasping and pulling the door attachment 14. The door attachment 14 should also be positioned sufficiently above the bottom edge 12*d* so that the door attachment 14 may be grasped with ease. For example, positioning the door attachment 14 about six inches from the second edge 12*c* and about three feet above the bottom edge 12*d* should be suitable for the uses contemplated herein. Based on a variety of factors (such as the design of the building exterior, the graphic design 16 to be displayed thereby and the intended use thereof), the door attachment 14 may be variously dimensioned. It is contemplated that a height of about ten and one-half inches and a width of about seven and one-half inches will be suitable for many of both the handle and push pad-type door attachments. It should be noted, however, that some business logos are better suited for door attachments having dimensions and shapes other than those specifically described herein. It should be further noted that some commercial establishments prefer door-width handles and push pads which are typically sized to have a height of about six (6) inches and a width of about twenty-four (24) inches.

Figure 2:
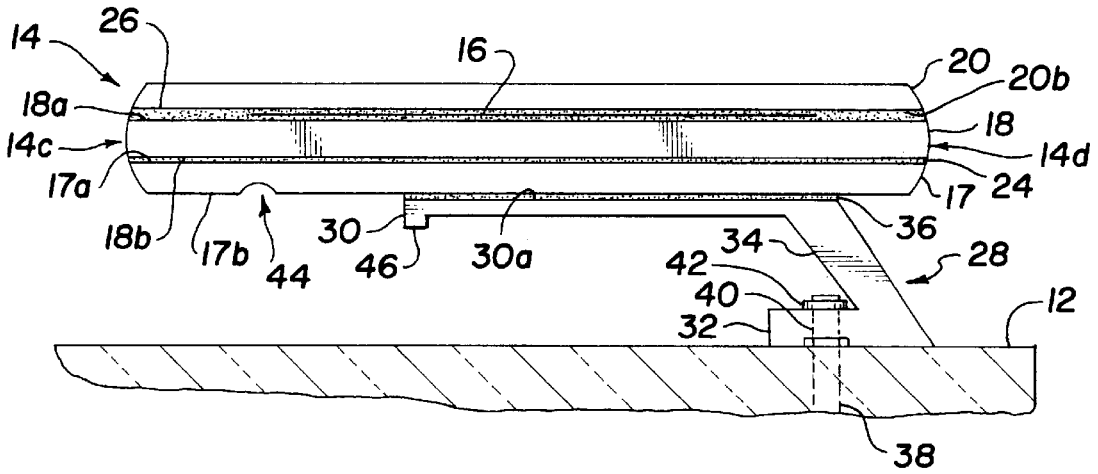
FIG. 2 is a cross-sectional view taken along lines 2—2 of FIG. 1.

As shown in FIG. 2, the door attachment 14 includes a first (or lower) body portion 17, a second (or main) body portion 18 and a third (or upper) body portion 20. In the embodiment illustrated, the main body portion 18 and the upper body portion 20 are transparent while the lower body portion 17 is opaque colored material. It should be understood, however, that a partially opaque or transparent material is equally suitable for use as the lower body portion 17 while partially or fully opaque materials may be selected for use as the main body portion 18 and some partially opaque materials may even be suitable for use as the upper body portion 20. Of the various possible combinations of transparent, opaque and partially-opaque body portions, the most desireable combination for any given application of the invention will vary based on considerations such as coloration of the graphic display 16 and/or existence of any color combinations associated with the subject business establishment. Absent the existence of such a color combination, however, it is contemplated that an opaque white lower body portion 17, in combination with transparent main and upper body portions 18 and 20, will be best suited for most applications.

A graphic display decal 16 is fixedly attached to the top side surface 18*a* of the main body portion 18. It is contemplated that a variety of techniques may be used to affix the graphic display 18 to the top side surface 18*a*. For example, a sheet of adhesive vinyl having a layer of adhesive on a rear side surface thereof and on which the graphic display decal 16 has been printed or otherwise formed may be placed on the top side surface 18*a*. The unprinted portions of the sheet are then pulled away, leaving the graphic display 16 mounted on the top side surface 18*a*. Alternately, the graphic display 16 may be imprinted on the top side surface 18*a*, for example, using a stenciling process or the like. Of course, in this embodiment a front surface of the graphic display 16 will have a layer of adhesive. Furthermore, while the embodiment of the invention illustrated employs a graphic display decal 16 attached to the top side surface 18*a* of the main body portion 18, it should be understood that attaching a graphic display 16 to other surfaces of the door attachment 14 is equally suitable for the purposes contemplated herein. For example, graphic display decal 16 may be attached to a bottom side surface 20*b* of the upper body portion 20. In any event, however, to minimize wear of the graphic display 16 it is preferred that the display be a decal 16 which is attached to the door attachment 14 such that it will be sandwiched between a pair of body portions of the attachment.

In the preferred embodiment, a first sheet of a transparent polyurethane 24 is placed between top side surface 17*a* of the lower body portion 17 and bottom side surface 18*b* of the main body portion 18. A second sheet of transparent polyurethane 26 is placed between top side surface 18*a* of the main body portion 18 (including the graphic display decal 16) and bottom side surface 20*b* of the upper body portion 20. The door attachment 14 is then heated to a temperature sufficiently high to melt the sheets of polyurethane and vacuum pressed to remove any air bubbles trapped between the top side surface 17*a* of the lower body portion 17 and the bottom side surface 18*b* of the main body portion 18 or between the top side surface 18*a* of the main body portion 18 and the bottom side surface 20*b* of the upper body portion 20. The door attachment is then cooled to room temperature. By treating the door attachment 14 in this manner, the first and second sheets 24 and 26 of polyurethane melt to fuse, respectively, the top side surface 17*a* of the lower body portion 17 to the bottom side 18*b* of the main body portion 18 and the top side surface 18*a* of the main body portion 18 to the bottom side surface 20*b* of the top body portion 20 (thereby fixedly securing the graphic display decal 16 therebetween).

As described above, the door attachment 14 is configured to include an opaque lower body portion 17, a transparent main body portion 18, a transparent upper body portion 20 and a graphic display 16 fixedly secured between the transparent main body portion 18 and the transparent main body portion 20. This embodiment is particularly well-suited to serve as a graphic display for a business establishment. Specifically, the graphic display decal 16 may be a business logo or other artistic rendering. Since the upper body portion 20 is transparent, the graphic display decal 16 is readily visible therethrough. The opaque lower body portion 17 provides a backdrop against which the graphic display decal 16 contrasts, thereby substantially enhancing visibility of the graphic display decal 16. Furthermore, the transparent main body portion 18 spaces the graphic display 16 from the opaque lower body portion 17, thereby causing the display 16 to appear positioned in a foreground relative to the contrasting backdrop created by the opaque lower body portion 17. The transparent main body portion 18 further enhances the graphic display by providing a three-dimensional visual perspective.

While the preferred embodiment of the door attachment 14 includes lower, main and upper body portions 17, 18 and 20, it should be understood that alternate configurations may include various numbers of body portions. For example, a door attachment comprising graphic display decal fixedly secured between either an opaque or transparent lower body portion and a transparent upper body portion may be suitable for some purposes. Furthermore, while edge side surfaces of the lower, main and upper body portions 17, 18 and 20 preferably have slightly rounded edges, it is contemplated that the edge surfaces thereof may be formed in a variety of shapes while remaining within the scope of the invention.

As illustrated in FIG. 2, a mounting bracket 28 fixedly secures the door attachment 14 to door 12. As described herein, the mounting bracket 28 is metal. However, other hardened materials may be used to form the mounting bracket 28. Furthermore, while it is preferred that the mounting bracket 28 be the same color as the opaque lower body portion 17 the mounting bracket 28 may be any of a variety of colors. Preferably, the color of the mounting bracket 28 is selected to correspond with the color scheme of the graphic display, particularly if the lower body portion 17 is transparent.

The mounting bracket 28 is preferably comprised of a first section 30 which secures the door attachment 14 thereto, a second section 32 configured for mounting the door attachment 14 and an intermediate section 34 which couples the first and second sections 30 and 32. While the first and second sections 30 and 32 appear generally parallel with each other in FIG. 2, the first section 30 is preferably slightly angled relative to the second section 32. In this configuration edge surface 14*c* of the door attachment 14 projects outwardly slightly further than edge surface 14*d*, thereby enhancing the ability to grip the door attachment 14.

A layer 36 of adhesive material (such as epoxy or the like) attaches bottom side surface 17*b* of the lower body portion 17 to upper side surface 30*a* of the first section 30 of the mounting bracket 28. The mounting bracket 28 is secured to the door 12 by a pair of bolts 38, one of which is visible in FIG. 2.

In the preferred embodiment, a pair of apertures 40 are formed in section 32 of the mounting bracket 28. Preferably, one of the apertures is formed in proximity with a top edge thereof and the other is formed in proximity with a lower edge. In this configuration, torque applied to the door attachment 14 is evenly distributed when transferred to the door 12, greatly reducing the likelihood that the door attachment 14 will be inadvertently detached from the door 12. It should be understood, however, that disclosure of a pair of bolts 38 and corresponding apertures 40 is purely exemplary and that any number of bolts 38 may be used to secure the door attachment 14 to the door 12. It is preferred, however, that the arrangement of apertures 40 in the mounting bracket 28 be configured similarly to standard door handles so that existing doors may be readily retrofitted with door attachments constructed in accordance with the invention.

For embodiments of the invention wherein the door attachment 14 operates as a door handle, it is contemplated that the door attachment be provided with one or more gripping surfaces to aid usability thereof. As shown in FIG. 2, the door attachment 14 is provided with two such gripping surfaces. More specifically, an indentation 44 is formed in the bottom side surface 17*b* of the lower body portion 17 to provide a first gripping surface and a projection 46 extends outwardly from the first section 30 of the mounting bracket 28 to provide a second gripping surface. Preferably, the indentation 44 extends from top to bottom edge side surfaces of the lower body portion 17 while the projection 46 extends from top to bottom edge side surfaces of the first section 30.

The door attachment described above incorporates a graphic display in accordance with the principles of the invention. By sandwiching the graphic display between a top side surface of a main body portion and a bottom side surface of a substantially transparent upper body portion which are fused together, the graphic display incorporated in the door attachment is both clearly visible and exceedingly wear-resistant. Furthermore, by selecting a transparent main body portion and fusing it to a an opaque lower body portion, a visually dramatic graphic display is formed which appears to be positioned in a foreground of a sharply contrasting backdrop.

While the invention has been described with particular reference to specific embodiments thereof, it will be apparent to those skilled in the art that the same principles may be used in similar arrangements. Furthermore, it will be recognized the invention is not limited to the precise structures described. Therefore, it is to be understood that although the invention has been described with particular reference to specific embodiments thereof, the forms of the invention shown and described in detail are to be taken as preferred embodiments of same. Various changes and modifications may be resorted to without departing from the spirit and scope of the invention as defined by the appended claims.

What is claimed:

1. A door attachment comprising:

(a) a first body portion having a front side surface;

(b) a second body portion having a rear side surface; and (c) a graphic display positioned between said front side surface of said first body portion and said rear side surface of said second body portion wherein (i) said front side surface of said first body portion is fused to said rear side surface of said second body portion to fixedly secure the graphic display therebetween;

(ii) said second body portion is sufficiently transparent that said graphic display is visible therethrough; and (iii) said door attachment is a handle and said first body portion further comprises a rear side surface having an indentation formed therein which provides a first gripping surface.

2. A door attachment as defined in claim 1 wherein said first body portion further comprises top and bottom side surfaces and said indentation extends from said top side surface to said bottom side surface.

3. A door attachment as defined in claim 2 further comprising a bracket having:

(a) a first section mounted to said rear side surface of said first body portion;

(b) a second section configured for mounting to a door; and (c) an intermediate section which couples said first section to said second section.

4. A door attachment as defined in claim 3 wherein said first section of said bracket is angled relative to said second section of said bracket.

5. A door attachment as defined in claim 3 wherein said first section of said bracket further comprises a front side surface mounted to said rear side surface of said first body portion and a rear side surface having a projection formed thereon which provides a second gripping surface for said door handle.

6. A door attachment as defined in claim 5 wherein said first section of said bracket further comprises top and bottom side surfaces with said projection extending from said top side surface to said bottom side surface.

7. A door attachment including a graphic display comprising:

(a) a first body portion which is substantially opaque and has a front side surface;

(b) a second body portion which is substantially transparent and has front and rear side surfaces with said front side surface of said first body portion fused to said rear side surface of said second body portion;

(c) a third body portion which is substantially transparent and has a rear side surface; and (d) a graphic display decal positioned between said front side surface of said second body portion and said rear side surface of said third body portion with said front side surface of said second body portion fused to said rear side surface of said third body portion to fixedly secure said graphic display therebetween wherein (i) said graphic display decal is visible through said third body portion;

(ii) said first body portion provides a backdrop against which said graphic display decal contrasts; and (iii) said second body portion spaces said graphic display decal relative to said opaque first body portion such that said graphic display appears in a foreground relative to said backdrop.

8. A door attachment as defined in claim 7 wherein said graphic display decal is mounted to said front side surface of said second body portion before said front side surface of said second body portion is fused to said rear side surface of said third body portion.

9. A door attachment as defined in claim 7 wherein said graphic display decal is mounted to said rear side surface of said third body portion before said front side surface of said second body portion is fused to said rear side surface of said third body portion.

10. A door attachment as defined in claim 7 wherein said door attachment is a door handle and said first body portion further comprises a rear side surface having an indentation formed therein which provides a first gripping surface for said door attachment.

11. A door attachment as defined in claim 10 wherein said first body portion further comprises top and bottom side surfaces and said indentation extends from said top side surface to said bottom side surface.

12. A door attachment as defined in claim 7 wherein said door attachment has a rear side face and includes a bracket having a first section mounted to said rear side face a second section configured for mounting to a door and an intermediate section which couples said first section to said second section.

13. A door attachment as defined in claim 12 wherein said first section of said bracket comprises a front side surface mounted to said rear side face and a rear side surface having a projection formed thereon which provides a second gripping surface for said door attachment.

14. A door attachment as defined in claim 13 wherein said first section of said bracket comprises top and bottom side surfaces and said projection extends from said top side surface to said bottom side surface.

15. A graphic display comprising:

(a) a first body portion which is substantially opaque and has a front side surface;

(b) a second body portion which is substantially transparent and has front and rear side surfaces with said front side surface of said first body portion fused to said rear side surface of said second body portion;

(c) a third body portion which is substantially transparent and has a rear side surface; and (d) a decal positioned between said front side surface of said second body portion and said rear side surface of said third body portion wherein (i) said front side surface of said second body portion is fused to said rear side surface of said third body portion to fixedly secure said decal therebetween;

(ii) said decal is visible through said third body portion;

(iii) said opaque first body portion provides a backdrop against which said decal contrasts; and (iv) said second body portion spaces said decal relative to said opaque first body portion such that said decal appears in a foreground relative to said backdrop.

16. A graphic display as defined in claim 15 wherein said decal is mounted to said front side surface of said second body portion before said front side surface of said second body portion is fused to said rear side surface of said third body portion.

17. A graphic display as defined in claim 15 wherein said decal is mounted to said rear side surface of said third body portion before said front side surface of said second body portion is fused to said rear side surface of said third body portion.

18. A graphic display as defined in claim 15 wherein said graphic display is mounted to a door and operates as a door handle for said door.

19. A graphic display as defined in claim 15 wherein said graphic display is mounted to a door and operates as a push pad for said door.

20. The combination comprising:

(a) a door hingedly mounted for pivotal movement about a first edge thereof; and (b) a graphic display comprising (i) a first body portion which is substantially opaque and has a front side surface;

(ii) a second body portion which is substantially transparent and has front and rear side surfaces with said front side surface of said first body portion fused to said rear side surface of said second body portion;

(iii) a third body portion which is substantially transparent and has a rear side surface; and (iv) a decal positioned between said front side surface of said second body portion and said rear side surface of said third body portion wherein said front side surface of said second body portion is fused to said rear side surface of said third body portion to fixedly secure said decal therebetween; said decal is visible through said third body portion; said opaque first body portion provides a backdrop against which said decal contrasts; and said second body portion spaces said decal relative to said opaque first body portion such that said decal appears in a foreground relative to said backdrop.

21. The combination defined in claim 20 wherein said graphic display is a door handle.

22. The combination defined in claim 20 wherein said graphic display is a push pad.

23. The combination defined in claim 20 wherein said graphic display is a business logo.

* * * * *

UNITED STATES PATENT AND TRADEMARK OFFICE

CERTIFICATE OF CORRECTION

PATENT NO. : 6,119,385
DATED : September 19, 2000
INVENTOR(S) : Olivier

It is certified that error appears in the above-identified patent and that said Letters Patent is hereby corrected as shown below:

Title page,
The following should be deleted:
"[*] Notice: This patent is subject to a terminal disclaimer."

Column 1,
between DOOR ATTACHMENT and BACKGROUND OF THE INVENTION, the following shoulde be inserted:

--- This invention relates to attachments for doors. More particularly, it relates to door attachments such as handles, push pads and the lime which incorporate graphic diaplays. ---

Column 7,
Line 37, should read --- having a first section mounted to said rear side face, a second ---

Signed and Sealed this

Fourteenth Day of August, 2001

*Attest:*

Nicholas P. Godici

*Attesting Officer*

NICHOLAS P. GODICI
*Acting Director of the United States Patent and Trademark Office*